US008425240B2

(12) United States Patent
Lee et al.

(10) Patent No.: US 8,425,240 B2
(45) Date of Patent: Apr. 23, 2013

(54) SHIELD COVER FOR BRAIDED WIRE SHIELD

(75) Inventors: Chul-Sub Lee, Daegu (KR); Sang-Hee Lee, Gyeongsangbuk-do (KR); Kun-Taek Lim, Gyeongsangbuk-do (KR)

(73) Assignee: Tyco Electronics Amp Korea Ltd., Kyungsangbuk-Do (KR)

( * ) Notice: Subject to any disclaimer, the term of this patent is extended or adjusted under 35 U.S.C. 154(b) by 0 days.

(21) Appl. No.: 13/234,693

(22) Filed: Sep. 16, 2011

(65) Prior Publication Data

US 2012/0028500 A1 Feb. 2, 2012

Related U.S. Application Data

(63) Continuation of application No. PCT/KR2010/001419, filed on Mar. 8, 2010.

(30) Foreign Application Priority Data

Mar. 16, 2009 (KR) ..... 10-2009-0022157

(51) Int. Cl.
*H01R 13/648* (2006.01)

(52) U.S. Cl.
USPC ..... 439/99; 439/607.41

(58) Field of Classification Search ..... 439/98, 439/99, 607.41–607.52
See application file for complete search history.

(56) References Cited

U.S. PATENT DOCUMENTS 5,429,529 A * 7/1995 Hashizawa et al. ..... 439/607.5
5,707,253 A * 1/1998 Matsumoto et al. ..... 439/607.5
5,746,625 A * 5/1998 Aparicio et al. ..... 439/607.41
6,048,227 A * 4/2000 Rupp et al. ..... 439/607.41
6,116,955 A * 9/2000 Lazaro, Jr. ..... 439/607.45
6,200,162 B1 3/2001 Aoyama et al.
6,688,896 B2 * 2/2004 Matsumoto ..... 439/98
6,764,350 B2 * 7/2004 Kosmala ..... 439/752
6,793,532 B2 * 9/2004 Saito et al. ..... 439/607.41

(Continued)

FOREIGN PATENT DOCUMENTS

JP 2001128330 A 5/2001
JP 2004327100 A 11/2004

(Continued)

OTHER PUBLICATIONS

PCT International Search Report dated Oct. 12, 2010 for International Application No. PCT/KR2010/001419, Applicant Tyco Electronics AMP Korea Ltd. et al., International Filing Date Mar. 8, 2010, 3 pages.

(Continued)

*Primary Examiner* — Ross Gushi
(74) *Attorney, Agent, or Firm* — Barley Snyder

(57) ABSTRACT

A shield cover for a braided wire shield that is capable of securely fixing a braided wire to a shield member through a single pressing operation. The shield cover having a mating end, an inner casing, an outer cover housing. and a securing section. The inner casing positioned at an end opposite the mating end and having a shield receiving passageway. The outer cover housing positioned at the mating end of the shield cover and forming a connector receiving passageway being wider than the shield receiving passageway. The securing section extends from the inner casing toward the mating end and positioned apart from the outer cover housing.

20 Claims, 7 Drawing Sheets

U.S. PATENT DOCUMENTS

| | | | | |
|---|---|---|---|---|
| 7,044,756 | B1 * | 5/2006 | Asakura et al. | 439/98 |
| 7,268,298 | B2 * | 9/2007 | Asakura et al. | 174/78 |
| 7,368,664 | B2 * | 5/2008 | Asakura et al. | 174/78 |
| 7,476,127 | B1 * | 1/2009 | Wei | 439/583 |
| 7,491,071 | B2 * | 2/2009 | Hamai et al. | 439/98 |
| 7,530,848 | B2 * | 5/2009 | Nagashima et al. | 439/607.41 |
| 7,534,138 | B1 * | 5/2009 | Gump et al. | 439/564 |
| 7,632,147 | B2 * | 12/2009 | Farahani et al. | 439/607.41 |
| 7,666,032 | B2 * | 2/2010 | Aoki et al. | 439/607.41 |
| 7,811,133 | B2 * | 10/2010 | Gray | 439/607.41 |
| 7,828,593 | B2 * | 11/2010 | Gilliam | 439/578 |
| 8,057,258 | B2 * | 11/2011 | Kawaguchi et al. | 439/585 |
| 8,157,594 | B2 * | 4/2012 | Gilliam | 439/607.41 |
| 8,192,222 | B2 * | 6/2012 | Kameyama | 439/404 |
| 2002/0094724 | A1 * | 7/2002 | Saito et al. | 439/610 |
| 2003/0003805 | A1 * | 1/2003 | Yamamoto | 439/610 |
| 2006/0121758 | A1 * | 6/2006 | Asakura et al. | 439/98 |
| 2006/0205272 | A1 * | 9/2006 | Rodrigues | 439/585 |
| 2007/0082534 | A1 * | 4/2007 | Wada et al. | 439/352 |
| 2009/0227150 | A1 * | 9/2009 | Farahani et al. | 439/660 |
| 2009/0280685 | A1 * | 11/2009 | Gray | 439/607.41 |
| 2010/0136832 | A1 * | 6/2010 | Kawaguchi et al. | 439/607.03 |
| 2011/0081803 | A1 * | 4/2011 | Kawaguchi et al. | 439/607.5 |
| 2011/0136391 | A1 * | 6/2011 | Kameyama | 439/660 |
| 2012/0028500 | A1 * | 2/2012 | Lee et al. | 439/607.01 |
| 2012/0142214 | A1 * | 6/2012 | Kawamura | 439/571 |

FOREIGN PATENT DOCUMENTS

| | | | |
|---|---|---|---|
| JP | 2005203217 | A | 7/2005 |
| JP | 2008288021 | A | 11/2008 |
| JP | 2008288121 | A | 11/2008 |

OTHER PUBLICATIONS

Patent Abstract Bibliographic Data JP2004327100 (A), Published Nov. 18, 2004, Inventor: Yoshioka Chikahiro, et al., Applicant, Auto Network Gijutsu Kenkyusho, et al., 1 Page.

Patent Abstract Bibliographic Data JP2008288021 (A), Published Nov. 27, 2008, Inventor: Suzuki Masatake, et al., Applicant, Yazaki Corp, 1 Page.

* cited by examiner

SHIELD COVER FOR BRAIDED WIRE SHIELD

CROSS-REFERENCE TO RELATED APPLICATION

This application is a continuation of PCT International Application No. PCT/KR2010/001419 filed Mar. 8, 2010, which claims priority under 35 U.S.C. §119 to Korean Patent Application No. KR 10-2009-0022157, filed Mar. 16, 2009.

FIELD OF THE INVENTION

The present invention relates to a shield cover and more particularly to a shield cover for a braided wire shield that securely connects a braided wire to a shield member.

BACKGROUND

It is necessary for an electric cable, through which an electric signal is transmitted or high-voltage electric power is supplied, to be shielded such that the electric signal is protected from interference from external electromagnetic waves. Additionally, it is necessary to prevent an electromagnetic wave generated from the electric cable itself from affecting sensitive electronic equipment in the vicinity of the electromagnetic wave.

Such shielding may be achieved by the provision of, for example, a braided wire including a plurality of flexible conducting wires woven in the form of a net to wrap the electric cable therein.

Meanwhile, connection between electric cables or connection between an electric cable and a different device may be achieved mainly through an exclusive connector. The connector includes a lead electrically connected to the electric cable and a shield member, made of a conductive material, such as metal, electrically connected to a braided wire for shielding the lead.

The shield member is configured to wrap the lead therein. The shield member is provided not only in a female connector, but also in a male connector. The shield members contact each other when the female and male connectors are coupled to each other. Consequently, the leads connected to the respective electric cables are coupled to each other in a shield space of the shield member electrically connected to the braided wire for shielding an electric signal or an electric current passing through the connectors.

A known method of connecting a shield member 12 and a braided wire T is shown in FIG. 7.

According to the known method shown in FIG. 7, one end of the braided wire, wrapping an electric cable W therein, is widened to surround the outer circumference of the shield member 12 using an additional braided wire widening apparatus, and additional clamp members 14 are coupled to the shield member 12 above and below the shield member 12 for securely fixing the braided wire T to the shield member 12.

In FIG. 7, two clamp members, i.e., an upper clamp member and a lower clamp member, are coupled to the shield member. Alternatively, a band type clamp member may be provided. In this case, opposite ends of the clamp member are fixedly connected to each other by a screw.

According to the known method using the clamp members, the braided wire may be easily torn due to fastening force of the clamp members. In particular, when vertical protrusions or depressions are formed at the outer circumference of the shield member, and the braided wire located at the protrusions or depressions is pressed by the clamp members, the braided wire may be plastically deformed, resulting in plastically deformation of the braided wire, due to an external force, such as vibration or pulling force. Furthermore, the braided wire may be easily torn during subsequent use thereof. As result, the shielding performance of the braided wire considerably deteriorates, and consequently, noise may be generated in an electric signal, and therefore, corresponding equipment may malfunction.

Also, it is necessary to perform a process for coupling the clamp members to the shield member, resulting in increased labor costs. In addition, it is necessary to provide an apparatus for coupling the clamp members to the shield member, resulting in an increase in apparatus-related costs. Furthermore, time for coupling the clamp members to the shield member is necessary, with productivity being lowered.

SUMMARY

Therefore, the present invention has been made in view of the above problems, and it is an object of the present invention to provide a shield cover for a braided wire shield that is capable of securely fixing a braided wire to the outside of a shield member through a single pressing operation.

The shield cover having a mating end, an inner casing, an outer cover housing, and a securing section. The inner casing positioned at an end opposite the mating end and having a shield receiving passageway. The outer cover housing positioned at the mating end of the shield cover and forming a connector receiving passageway being wider than the shield receiving passageway. The securing section extends from the inner casing toward the mating end and positioned apart from the outer cover housing.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE EMBODIMENT(S)

Figure 1:
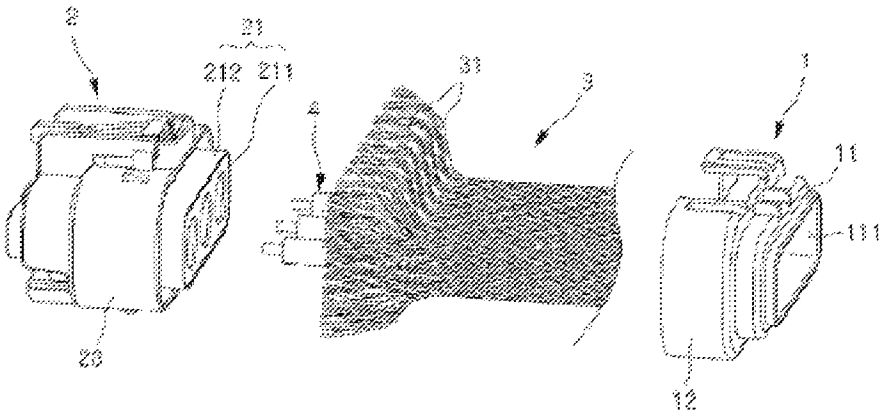
FIG. 1 is a perspective view showing a connector housing, a braided wire, and a shield cover for a braided wire shield according to the invention before assembly thereof.

Now, one embodiment of the invention will be described in detail with reference to the accompanying drawings. The same or similar elements are denoted by the same reference numerals even though they are depicted in different drawings.

First, with reference to FIGS. 1-3, a connector housing 2 is shown, on which a shield cover 1 according to the invention will be fitted, and a shield unit 21, against which a braided wire 3 is tightly pressed by the shield cover 1, will be described.

The connector housing 2 includes a lead 22 electrically connected to an electric cable 4 wrapped in the braided wire 3 and a shield unit 21 for shielding the lead 22. The shield unit 21 includes an insulator 211 for wrapping the lead 22 and the electric cable 4 and a shield member 212 surrounding the insulator 211.

The connector housing 2 further includes an outer insulator 23 surrounding the shield unit 21. Between an outer cover housing of the shield unit 21 at the rear thereof and an inner circumferential section of the outer insulator 23 at the rear thereof is defined an inner space P, in which one end of the braided wire 3 contacting the shield member 212 is located.

In shown embodiment, the shield cover 1 for the braided wire shield is fitted on the connector housing 2 to securely fix the braided wire 3 wrapping the electric cable 4 therein to the shield member 212 of the connector housing 2 in an electrically conducting state.

The shield cover 1 includes an inner casing 11 positioned at a cable receiving end of the shield cover 1 and forming a receiving passageway 111 through which the electric cable 4 wrapped in the braided wire 3 extends. The shield cover 1 is coupled to the connector housing 2 through an outer cover housing 12 positioned at a mating end of the shield cover 1. The outer cover housing 12 is wider than the inner casing 11.

The coupling between the shield cover 1 and the connector housing 2 may be achieved through a well-known structure in which a hole is formed in the outer cover housing of the shield cover 1, and a protrusion formed at the connector housing 2 is inserted into the hole.

In the shield cover 1 includes a securing section 13 extending frontward from the inner casing 11 such that the securing section 13 is spaced apart from the outer cover housing 12. The securing section 13 is located in the inner space P for fixing the braided wire 3 to the outside of the shield unit 21 in a grounded state. The securing section 13 extends frontward from the inside of the shield cover 1. Specifically, the securing section 13 is formed in the shape of a cantilever having one end fixed to the inside of the shield cover 1. It is preferable for the securing section 13 to have elasticity in the direction in which the securing section 13 is widened when the securing section 13 contacts the shield unit 21.

In this case, the securing section 13 pushes the corresponding end of the braided wire 3 into the inner space P defined between the outer cover housing of the shield unit 21 at the rear thereof and the inner circumferential section of the connector housing 2 at the rear thereof during forcible fitting of the shield cover 1 onto the connector housing 2, with the result that the braided wire 3 is automatically adjusted and arranged.

The securing section 13 has an inner fixing section 131 formed in parallel to the outer cover housing of the shield unit 21. The inner fixing section 131 includes a fixing plane 131*a* for pressing the braided wire 3 against the outside of the shield unit 21 to fix the braided wire 3 and an inclined plane 131*b* extending frontward from the fixing plane 131*a* in a tapered manner.

The inclined plane 131*b* formed at the front of the inner fixing section 131 prevents the securing section 13 from being damaged due to excessive load in an initial process for pushing the braided wire 3 into the shield unit 21. Also, the inclined plane 131*b* forms an excess receiving space for receiving tangled portions of the corresponding end of the braided wire 3 after fitting of the shield cover 1 onto the connector housing 2.

Meanwhile, the securing section 13 includes a vertical contact plane 14 positioned along the rear thereof, for pressing the braided wire 3 against one end of the shield unit 21. The vertical contact plane 14 includes protuberances 141 for partially pressing the braided wire 3 to prevent separation of the braided wire 3.

The vertical contact plane 14 protrudes from the rear of the securing section 13. When the shield cover 1 is completely fitted onto the connector housing 2, the vertical contact plane 14 comes into plane contact with the corresponding end of the shield unit 21 at the rear thereof.

The inner casing 11 of the shield cover 1 may vertically extend rearward to form the vertical contact plane 14. Alternatively, the vertical contact plane 14 may extend from the rear of the securing section 13 toward the interior of the shield cover 1.

Meanwhile, the protuberances 141 extend from the vertical contact plane 14 for pressing the braided wire 3 against the corresponding end of the shield unit 21 with greater pressing force to prevent separation of the braided wire 3 due to slippage thereof.

The protuberances 141 may be formed in the shape of hemispheric or conical protrusions extending from the vertical contact plane 14 to press the braided wire 3. The vertical contact plane 14 may be formed in the shape of saw teeth to increase pressing force through line contact thereof.

Hereinafter, the operation of the shield cover 1 for the braided wire shield according to the embodiment shown will be described in detail with reference to FIGS. 2 and 4 to 6.

Figure 2:
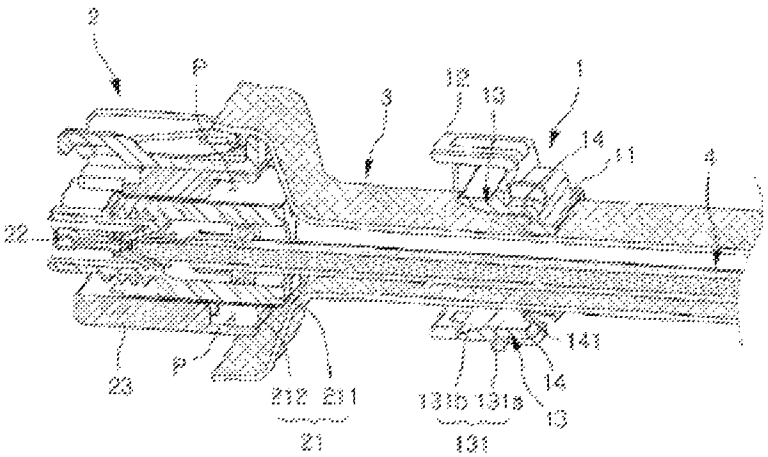
FIG. 2 is a partial sectional view of the connector housing, the braided wire, and the shield cover for the braided wire shield shown in FIG. 1 after assembly thereof.
Figure 3:
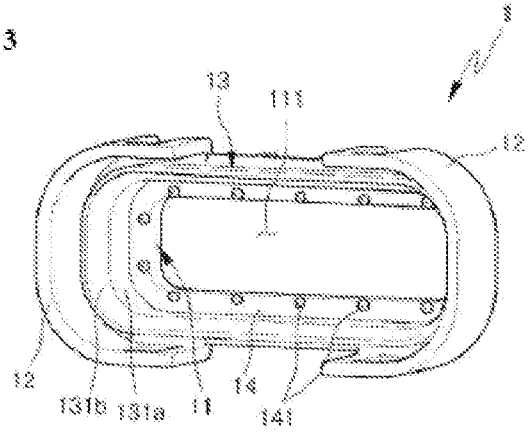
FIG. 3 is a perspective view of the shield cover for the braided wire shield shown in FIG. 1.

First, as shown in FIG. 2, one end of the braided wire 3 is widened such that the outer size of the braided wire 3 is greater than that of the connector housing 2 using an additional braided wire widening apparatus (not shown) in a state in which the electric cable 4 wrapped in the braided wire 3 extends through the inner casing 11 of the shield cover 1, and the electric cable 4 is connected to the lead 22 of the connector housing 2.

Since the braided wire 3 includes a plurality of conducting wires woven in the form of a net, some of the conducting wires may be easily tangled when the end of the braided wire 3 is widened.

As a result, some of the conducting wires overlap one another at the widened end of the braided wire 3, and therefore, the thickness of the conducting wires is increased. Some of the conducting wires are curled and twisted at the widened end of the braided wire 3. In addition, some of the conducting wires lump in a certain direction at the widened end of the braided wire 3, with the result that the conducting wires are not uniformly distributed.

Figure 4:
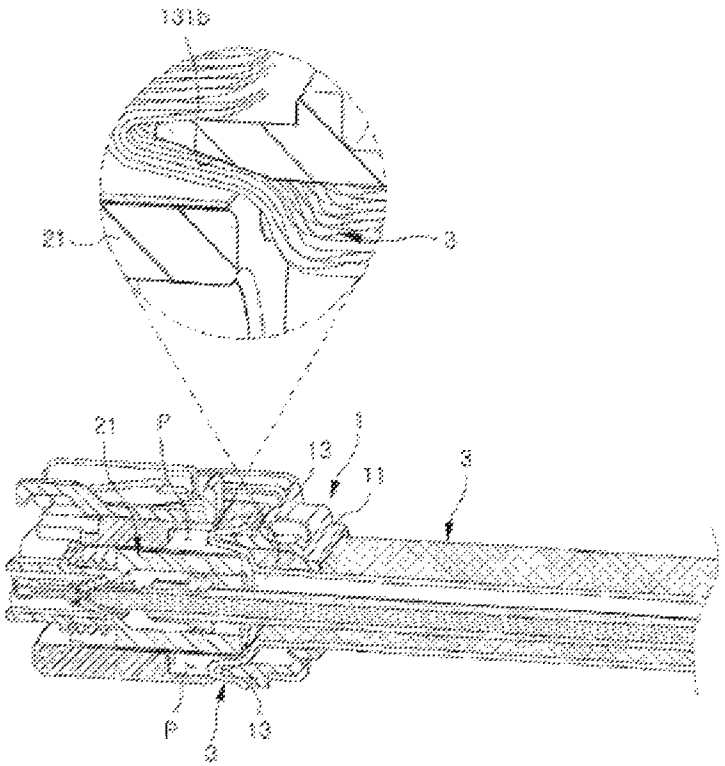
FIG. 4 is a partial sectional view showing another use of the shield cover for the braided wire shield shown in FIG. 1.

When the shield cover 1 is fitted onto the connector housing 2, as shown in FIG. 4, the widened end of the braided wire 3 is narrowed to tightly wrap the electric cable 4 by the inner casing 11 of the shield cover 1. Also, the widened end of the braided wire 3 is pushed to the outside of the shield unit 21, i.e., into the inner space P, by the securing section 13.

At this time, the inclined plane 131*b* of the securing section 13 presses the braided wire 3 placed on the edge of the shield unit 21 to align the conducting wires of the braided wire 3 in the longitudinal direction of the shield unit 21. As a result, the securing section 13 is advanced along the braided wire 3 aligned in the longitudinal direction of the shield unit 21. Consequently, a large load is not applied to the securing section 13 during initial fitting of the shield cover 1 onto the connector housing 2, and therefore, the breakage of the securing section 13 or the shield cover 1 due to the load applied to the securing section 13 is prevented when the securing section 13 is fitted in the outer circumference part of the shield unit 21.

Figure 5:
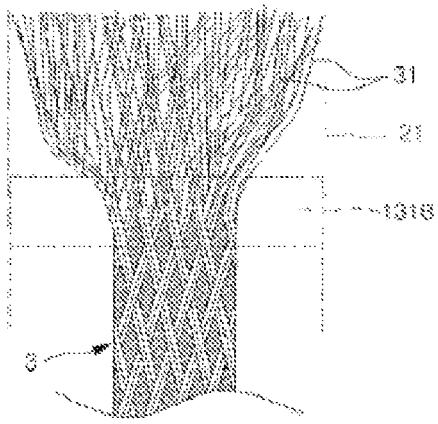
FIG. 5 is a schematic plan view of FIG. 4.

Referring to FIG. 5, the braided wire 3 is slowly pressed against the shield member 212 by the inclined plane 131*b*. With the increase of pressing force applied to the braided wire 3, therefore, some of the conducting wires 31 crowded to one side are dispersed to come into uniform contact with the outer cover housing of the shield unit 21.

As a result, the conducting wires 31 of the braided wire 3 are uniformly arranged and pressed at the outer cover housing of the shield unit 21, thereby maintaining a lead shielding performance thereof.

Figure 6:
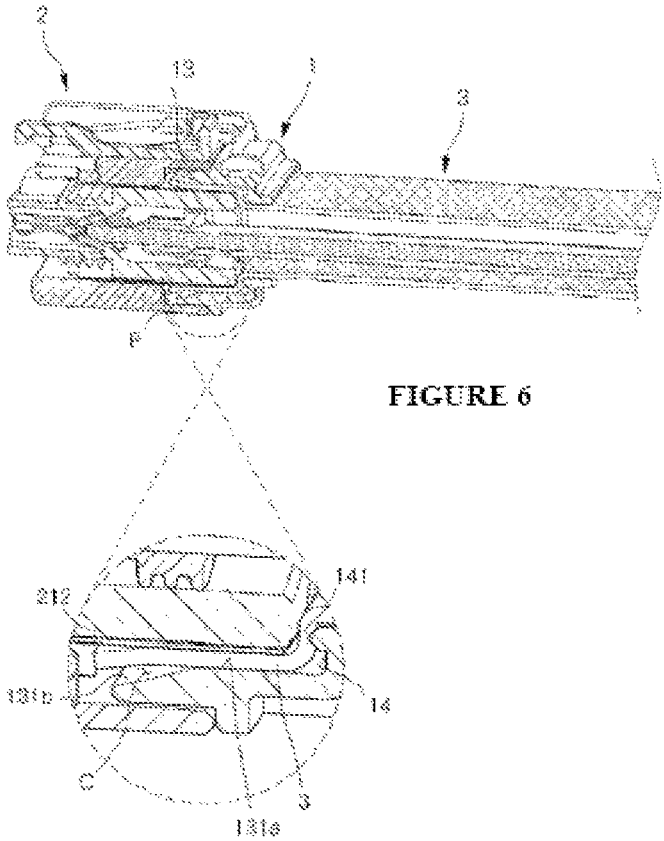
FIG. 6 is a partial sectional view showing a further use of the shield cover for the braided wire shield shown in FIG. 1.
Figure 7:
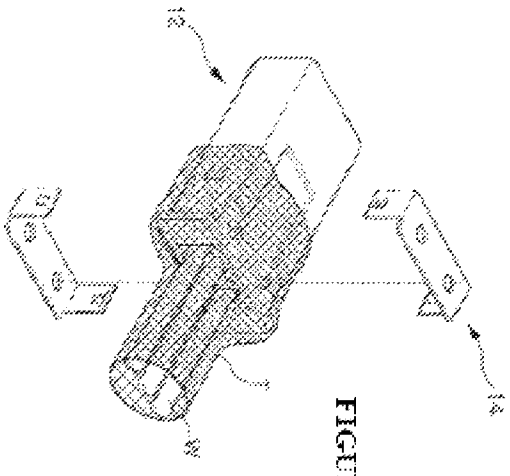
FIG. 7 is a perspective view of a known connection between a known shield member and a braided wire.

Meanwhile, as shown in FIG. 6, the securing section 13 is deeply inserted into the inner space P when the shield cover 1 is completely coupled to the connector housing 2. At this time, the braided wire 3 is tightly fixed to the shield member 212 by the fixing plane 131*a* of the securing section 13.

Also, the inclined plane 131*b* forms a receiving space C for receiving some curled conducting wires at the end of the braided wire 3. Consequently, the securing section 13 is prevented from being widened due to the curled conducting wires, and therefore, the braided wire 3 is sufficiently pressed. That is, some conducting wires curled during widening of the braided wire 3 are placed in the receiving space formed by the inclined plane 131*b*, with the result that the securing section 13 is prevented from being widened, thereby achieving stable fixing of the braided wire 3.

Also, the protuberances 141 formed at the vertical contact plane 14 strongly press the braided wire 3 against the corresponding end of the shield unit 21. Consequently, the braided wire 3 is prevented from sliding and being separated from the vertical contact plane 14 when the braided wire 3 is pulled rearward.

As previously described, the protuberances 141 strongly press the conducting wires uniformly distributed at the inclined plane 131*b* of the securing section 13, thereby more effectively preventing separation of the braided wire 3.

In this way, the braided wire 3 is aligned and pressed during the coupling between the shield cover 1 and the connector housing 2 through a single push operation, and therefore, an additional clamp member, which is necessary in the related art, is not needed. As a result, the coupling of the clamp member to the outer components is not needed. Consequently, manufacturing costs are reduced, and rapid assembly is achieved.

Various embodiments have been described in carrying out the invention.

As is apparent from the above description, the shield cover 1 for the braided wire 3 shield according to the shown embodiment of the invention has the effect of securely fixing the braided wire 3 to the shield unit 21 of the connector housing 2 at a time through the securing section 13 having the inclined plane 131*b* without using an additional clamp.

Also, a large load is not applied to the securing section 13 by the inclined plane 131*b* formed at the inner circumference of the securing section 13 during initial fitting of the shield cover 1 onto the connector housing 2. Consequently, the shield cover 1 for the braided wire 3 shield according to the embodiment of the present invention has the effect of achieving easy coupling of the shield cover 1 to the connector housing 2 and preventing breakage of the securing section 13. In addition, the inclined plane 131*b* receives entangled portions of the braided wire 3 at the end thereof when the shield cover 1 is completely fitted onto the connector housing 2, and therefore, the braided wire 3 is securely presses by the fixing plane 131*a*. Consequently, the shield cover 1 for the braided wire 3 shield according to the embodiment of the present invention has the effect of maintaining pressing force applied to the braided wire 3.

Meanwhile, protuberances 141 may be formed at the vertical contact plane 14 strongly press the braided wire 3 against the corresponding end of the shield unit 21, and therefore, the braided wire 3 is prevented from sliding and being separated from the vertical contact plane 14 when the braided wire 3 is pulled rearward. Consequently, the shield cover 1 for the braided wire 3 shield according to the embodiment of the present invention has the effect of achieving secure fixing of the braided wire 3.

Therefore, the present invention has industrial applicability.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

What is claimed is:

1. A shield cover, comprising:

a mating end;

an inner casing having a shield receiving passageway positioned opposite the mating end;

an outer cover housing integrally formed with the inner casing and positioned along the mating end and forming a connector receiving passageway being wider than the shield receiving passageway; and an elastically deformable securing section extending from the inner casing toward the mating end and positioned apart from the outer cover housing.

2. The shield cover according to claim 1, wherein the securing section is positioned inside of the shield cover.

3. The shield cover according to claim 2, wherein the securing section has one end secured to the shield cover.

4. The shield cover according to claim 1, wherein the securing section has an inner fixing section positioned inside and extending parallel to the outer cover housing.

5. The shield cover according to claim 4, wherein the inner fixing section is tapered by a fixing plane and an inclined plane extending from the fixing plane toward the mating end.

6. The shield cover according to claim 5, wherein the inclined plane is positioned closer to the mating end than the inclined end.

7. The shield cover according to claim 6, wherein the inclined plane forms an excess receiving space between opposing sides of the inclined plane.

8. The shield cover according to claim 1, wherein the securing section further includes a vertical contact plane attached to the inner casing.

9. The shield cover according to claim 8, wherein the vertical contact plane extends from the securing section into the shield receiving passageway.

10. The shield cover according to claim 8, further comprising a protuberance extending from the vertical contact plane toward the mating end.

11. The shield cover according to claim 10, wherein the protuberance has a semispheric shape.

12. The shield cover according to claim 11, wherein the protuberance has a conical shape.

13. A shield cover, comprising:

a mating end;

an inner casing having a shield receiving passageway positioned opposite the mating end;

an outer cover housing positioned along the mating end and forming a connector receiving passageway being wider than the shield receiving passageway; and an elastically deformable securing section extending from the inner casing toward the mating end and positioned apart from the outer cover housing.

14. A shield cover, comprising:

a mating end;

an inner casing having a shield receiving passageway positioned opposite the mating end;

an outer cover housing positioned along the mating end and forming a connector receiving passageway being wider than the shield receiving passageway; and a securing section extending from the inner casing toward the mating end and positioned apart from the outer cover housing and having an inner fixing section positioned inside and extending parallel to the outer cover housing and being tapered by a fixing plane and an inclined plane extending from the fixing plane toward the mating end.

15. The shield cover according to claim 14, wherein the inclined plane is positioned closer to the mating end than the inclined end.

16. The shield cover according to claim 15, wherein the inclined plane forms an excess receiving space between opposing sides of the inclined plane.

17. A shield cover, comprising:

a mating end;

an inner casing having a shield receiving passageway positioned opposite the mating end;

an outer cover housing positioned along the mating end and forming a connector receiving passageway being wider than the shield receiving passageway;

a securing section extending from the inner casing toward the mating end and positioned apart from the outer cover housing and having a vertical contact plane attached to the inner casing and extends from the securing section into the shield receiving passageway.

18. The shield cover according to claim 17, further comprising a protuberance extending from the vertical contact plane toward the mating end.

19. The shield cover according to claim 18, wherein the protuberance has a semispheric shape.

20. The shield cover according to claim 18, wherein the protuberance has a conical shape.

* * * * *